US010378212B1

(12) United States Patent
Lawson

(10) Patent No.: US 10,378,212 B1
(45) Date of Patent: Aug. 13, 2019

(54) TREAD MOUNTING SYSTEM FOR SPIRAL STAIRCASE

(71) Applicant: Safe Rack LLC, Andrews, SC (US)

(72) Inventor: John Rutledge Lawson, Chapin, SC (US)

(73) Assignee: Safe Rack LLC, Andrews, SC (US)

( * ) Notice: Subject to any disclaimer, the term of this patent is extended or adjusted under 35 U.S.C. 154(b) by 0 days.

(21) Appl. No.: 15/987,668

(22) Filed: May 23, 2018

(51) Int. Cl.
*E04F 11/032* (2006.01)
*E04F 11/112* (2006.01)

(52) U.S. Cl.
CPC ..... *E04F 11/032* (2013.01); *E04F 11/112* (2013.01)

(58) Field of Classification Search
CPC ..... E04F 11/032; E04F 11/112
USPC ..... 52/187, 188
See application file for complete search history.

(56) References Cited

U.S. PATENT DOCUMENTS 485,449 A * 11/1892 Borneman ..... E04F 11/032 52/187
839,846 A 1/1907 Holden
874,014 A * 12/1907 Kurtzon ..... A47B 57/42 211/87.01
1,774,582 A 9/1930 Woodbridge
2,246,457 A * 6/1941 Schultz ..... F16B 35/04 182/228.1
2,799,767 A * 7/1957 Bremer ..... H05B 3/06 219/536
3,399,746 A * 9/1968 Wood ..... E06C 9/04 182/100
3,902,568 A * 9/1975 Erickson ..... E04G 5/06 182/92
4,190,992 A * 3/1980 Takenaga ..... E04F 11/032 182/187

(Continued)

FOREIGN PATENT DOCUMENTS

DE 3126665 A1 * 1/1983 ..... E04F 11/032
DE 4205855 A1 * 9/1993 ..... E04F 11/032

(Continued)

*Primary Examiner* — Jeanette E Chapman
(74) *Attorney, Agent, or Firm* — Nelson Mullins Riley & Scarborough, LLP

(57) ABSTRACT

A spiral staircase comprises a mounting column extending along a longitudinal axis. A plurality of tread assemblies each having a tread portion attached to a mounting plate is also provided. The tread assemblies are axially and angularly offset from an adjacent tread assemblies along the mounting column. In this aspect, each mounting plate has a first face that engages a corresponding portion of an outer surface of the mounting column and a second face from which the tread portion extends. Each of the tread assemblies further have attachment hardware that secures the mounting plate to the mounting column. Prior to attachment to the mounting column and in an unstressed state, the mounting plate has a first radius of curvature and the corresponding portion of the outer surface of the mounting column has a second radius of curvature. The first radius of curvature is less than the second radius of curvature so that when the mounting plate is secured to the column with the attachment hardware and the second face of the mounting plate substantially engages the mounting column, the mounting plate is in an elastically deformed state applying tension to the attachment hardware to inhibit loosening thereof.

15 Claims, 5 Drawing Sheets

(56) References Cited

U.S. PATENT DOCUMENTS 4,378,862 A * 4/1983 Carmel ..... E06C 1/383 182/106
4,527,367 A * 7/1985 Morellini ..... E04F 11/032 52/187
4,587,780 A * 5/1986 Rorke ..... E04F 11/032 182/92
4,791,764 A * 12/1988 Hicks ..... E04F 11/032 52/187
4,850,164 A 7/1989 McLeod
5,515,657 A * 5/1996 Chou ..... E04F 11/032 182/194
5,535,557 A * 7/1996 Garber ..... E04F 11/032 52/182
5,557,893 A 9/1996 Bowls
6,044,599 A * 4/2000 Wachenfeld ..... E04F 11/032 403/299
6,330,894 B1 * 12/2001 Austin ..... B25B 5/003 144/256.1
8,430,543 B2 * 4/2013 Goldwater ..... B62J 6/20 362/473
2008/0230759 A1 * 9/2008 Lass ..... E01F 15/0438 256/13.1
2008/0236066 A1 * 10/2008 Arnold ..... E04F 11/032 52/187
2009/0094907 A1 * 4/2009 Denicolo ..... E04F 11/032 52/188
2017/0241142 A1 * 8/2017 Catt ..... E04F 11/032

FOREIGN PATENT DOCUMENTS

DE 29915531 U1 * 12/1999 ..... E04F 11/032
EP 0659952 A1 * 6/1995 ..... E04F 11/032
EP 2154309 A1 * 2/2010 ..... E04F 11/032
FR 2442318 A1 * 6/1980 ..... E04F 11/032
FR 2712010 A1 * 5/1995 ..... E04F 11/032
GB 190628781 A * 5/1907
GB 1519768 A * 8/1978 ..... E04F 11/032

* cited by examiner

TREAD MOUNTING SYSTEM FOR SPIRAL STAIRCASE

FIELD OF THE INVENTION

The present invention relates to spiral staircases, and more particularly, to a tread mounting system for spiral staircases.

BACKGROUND OF THE INVENTION

A common means for attaching spiral staircase treads to a central column includes hollow cylindrical collars that slide over and surround the central column, wherein each tread is attached to a respective collar such as via weldment. Each collar stacks on top of the lower collars so that the height of the collar determines the vertical spacing between the treads.

In other cases, each tread will attach to a curved mounting plate with an inner radius of curvature about a vertical axis that is equal to the radius of curvature of the column's outer diameter, and the mounting plates attach to the column via bolts. However, repeated use of the staircase causes vibrations that can cause the bolts to loosen.

SUMMARY OF THE INVENTION

The present invention recognizes and addresses the foregoing considerations, and others, of prior art construction and methods.

One aspect of the present invention provides a spiral staircase comprising a mounting column extending along a longitudinal axis. A plurality of tread assemblies each having a tread portion attached to a mounting plate is also provided. The tread assemblies are each axially and angularly offset from an adjacent tread assembly along the mounting column along a helical path. In this aspect, each mounting plate has a first face that engages a corresponding portion of an outer surface of the mounting column and a second face from which the tread portion extends. Each of the tread assemblies further have attachment hardware that secures the mounting plate to the mounting column. Prior to attachment to the mounting column and in an unstressed state, the mounting plate has a first radius of curvature and the corresponding portion of the outer surface of the mounting column has a second radius of curvature. The first radius of curvature is less than the second radius of curvature so that when the mounting plate is secured to the mounting column with the attachment hardware and the first face of the mounting plate substantially engages the mounting column, the mounting plate is in an elastically deformed (joint preload) state applying tension to the attachment hardware to inhibit loosening thereof.

According to exemplary embodiments, the attachment hardware may comprise at least one elongate fastener (e.g., at least one threaded fastener). In this regard, a plurality of bolts with corresponding nuts may be utilized. For example, the bolts may each comprise a carriage bolt having a square neck portion adjacent to an enlarged head. The head of the carriage bolt may be spaced apart from the first face of the mounting plate. In such embodiments, the mounting column may define respective keyholes configured to receive the carriage bolts, wherein the keyholes each have an enlarged portion sized to receive the head of the carriage bolt and a reduced width slot extending from the enlarged portion for slidably receiving the square neck of the carriage bolt.

According to exemplary embodiments, the tread portion of each tread assembly may be generally fan-shaped. Moreover, the mounting plate may attach to an associated tread portion via weldment.

A further aspect of the present invention provides a tread mounting system for a spiral staircase comprising a mounting structure having an arcuate outer surface. A tread assembly having a tread portion attached to an arcuate mounting plate defining at least one hole therethrough is also provided. The tread assembly further has attachment hardware comprising at least one elongate fastener extending through the hole for connecting the tread assembly to the mounting structure. Prior to attachment to the mounting structure and in an unstressed state, a first face of the mounting plate has a first radius of curvature and the outer surface of the mounting column has a second radius of curvature. The first radius of curvature is less than the second radius of curvature so that when the mounting plate is secured to the mounting structure with the attachment hardware and the elongate fastener is tightened, the mounting plate is in an elastically deformed state applying tension to the elongate fastener to inhibit loosening thereof.

A still further aspect of the present invention provides a method of attaching a tread assembly of a spiral staircase to a vertical support column. One step of the method involves providing a tread assembly having a tread portion attached to an arcuate mounting plate defining at least one hole through which extends a fastener defining external threads, the mounting plate having a first face defining a first radius of curvature. Another step involves providing a support column extending along an axis, the support column having a plurality of axially and angularly spaced apart tread attachment locations, each of the tread attachment locations having an arcuate outer surface defining a corresponding aperture for receipt of the fastener, the arcuate outer surface defining a second radius of curvature that is greater than the first radius of curvature. According to another step of the method, the tread assembly is loosely connected to one of the tread attachment locations of the support column. According to another step, the fastener is tightened such that the arcuate mounting plate of the tread assembly is elastically deformed to be in substantial engagement with the tread attachment location and applies tension to the elongate fastener to inhibit loosening thereof.

Further aspects of the present invention may be discerned from the description herein. The accompanying drawings, which are incorporated in and constitute a part of this specification, illustrate one or more embodiments of the present invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
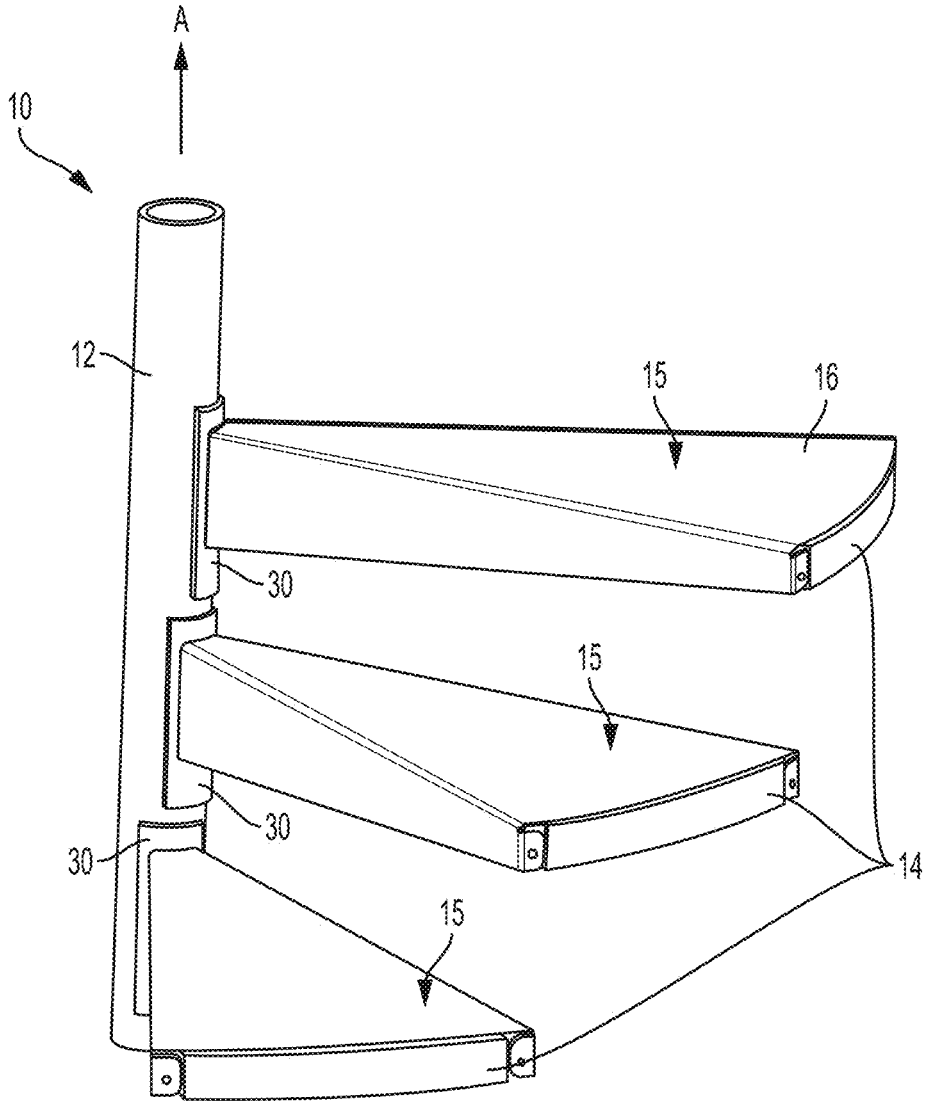
FIG. 1 shows a perspective view of a portion of a spiral staircase in accordance with the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, terms referring to a direction or a position relative to the orientation of a spiral staircase, such as but not limited to "vertical," "horizontal," "above," or "below," refer to directions and relative positions with respect to the spiral staircase orientation in its normal intended operation, as indicated in FIG. 1.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used herein and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

Figure 2:
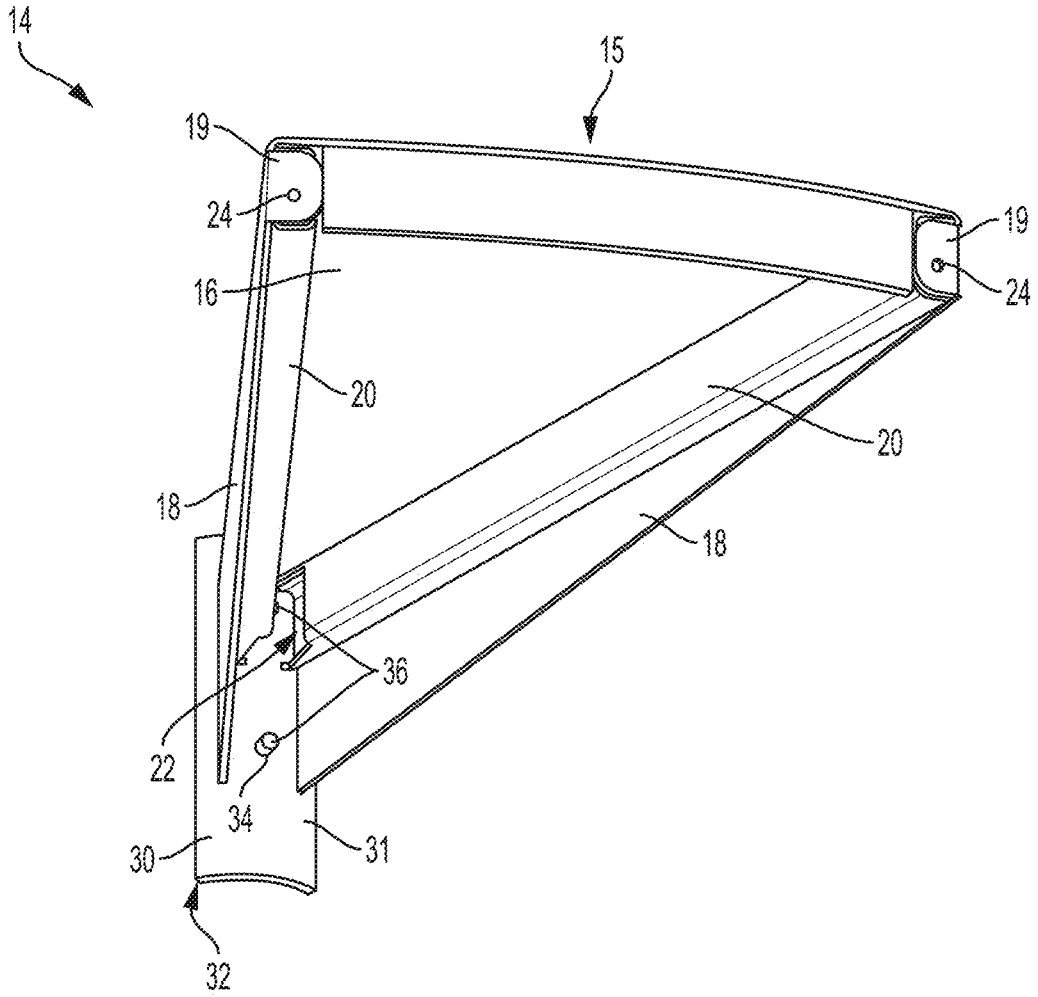
FIG. 2 is a bottom perspective view of a tread assembly of the spiral staircase as shown in FIG. 1.

Referring now to FIGS. 1 and 2, a spiral staircase 10 includes a vertically oriented, hollow cylindrical column 12 onto which tread assemblies 14 attach. Each tread assembly 14 includes a tread portion 15 and a mounting plate 30. In this case, tread portion 15 is fabricated at least in part from sheet metal and includes a horizontal, generally planar step portion 16 that has edges extending radially from the column so that portion 16 has a wedge (i.e., fan) shape. An outer edge of portion 16 has an arcuate curve with a radius that is equal to the edge's radial distance from the center axis A of column 12. With particular reference to FIG. 2, vertically planar side flanges 18 extend downward from the radially extending edges of step portion 16 along the entire respective radial edge's length, and tabs 19 bend inward (i.e., toward each other) from edges of respective side flanges 18 opposite column 12 and extend below the arcuate outer edge of portion 16. Each tab 19 has a through-hole 24 that provides an attachment point for mounting hardware to attach a guardrail and handrail weldment assembly (not shown). Side flanges 18 have a trapezoidal profile so that the proximal edge nearer the column is longer than the opposite distal edge. A pair of hollow reinforcement tubes 20 have vertically elongated rectangular cross sections and attach via welding below step portion 16, extending the entire radial distance along each corner where step portion 16 meets a respective side flange 18 to thereby provide rigidity to the tread. Each reinforcement tube 20 has a proximal cutout 22 that provides access to carriage bolts and nuts, discussed below.

Figure 3:
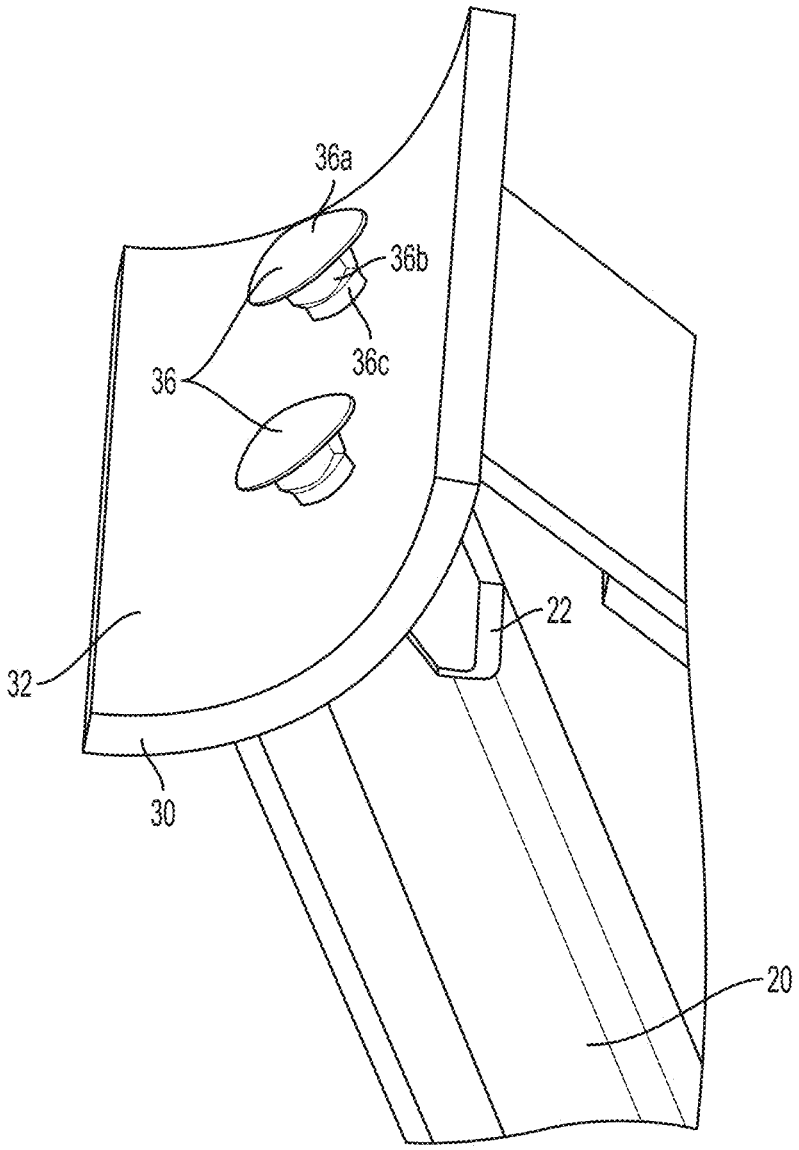
FIG. 3 is a partial perspective view of a reverse side of a portion of the tread assembly as shown in FIG. 2.
Figure 4:
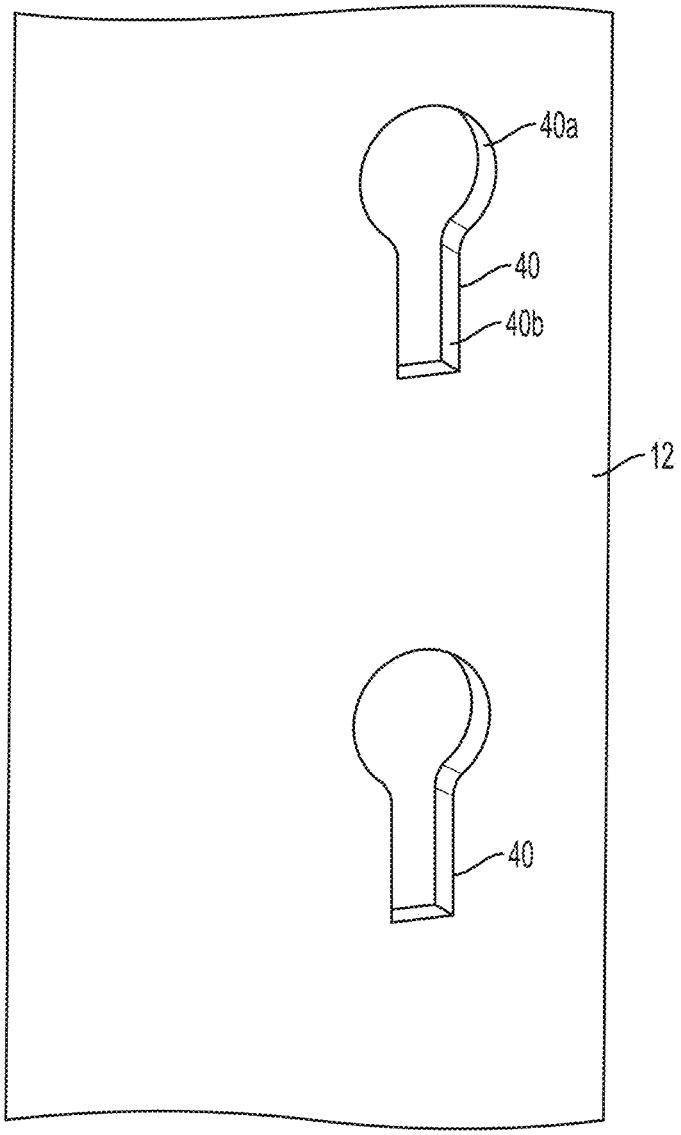
FIG. 4 is a partial perspective view of a portion of a support column of the spiral staircase in FIG. 1 that shows mounting keyholes for attaching a tread assembly to the column.

Each tread portion 15 attaches via weldment to an arcuate mounting plate 30 that has a curvature so that it defines a portion of a hollow cylinder. Mounting plate 30 defines two vertically offset through-holes that receive respective carriage bolts 36. Referring to FIGS. 3 and 4, carriage bolts 36 include an enlarged domed head 36*a*, square neck portion 36*b*, and threaded shank 36*c*. Column 12 has a plurality of tread attachment locations each defining a pair of vertically offset keyholes 40 for tread assembly mounting that are spaced to match the spacing of holes 34 in mounting plate 30. Each pair of keyholes 40 is spaced axially with respect to the next upper or lower keyhole pair to provide a selected step height. The keyhole pairs are also rotationally offset (i.e., angularly spaced) about the column's axis so that each step partially overhangs a respective adjacent tread below and the spiral arrangement is provided.

Keyholes 40 each include an enlarged circular portion 40*a* that is sized to receive head 36*a* and a reduced width slot portion 40*b* with a width that is large enough to receive square neck portion 36*b* of carriage bolt 36 when opposite flat sides thereof are aligned with the sides of the slot. Slot portion 40*b* is narrow enough that the square neck portion cannot significantly rotate about the bolt's axis of elongation when disposed within the slot. With this configuration, tread assemblies 14 may be mounted and fastened to column 12 (FIG. 1) from a single side of column 12. That is, keyholes 40 receive respective carriage bolts 36 that are inserted through circular portion 40*a* and slid down into slot portion 40*b*, and respective nuts 42 tighten down on threaded shank 36*c* against mounting plate 30.

Figure 5A:
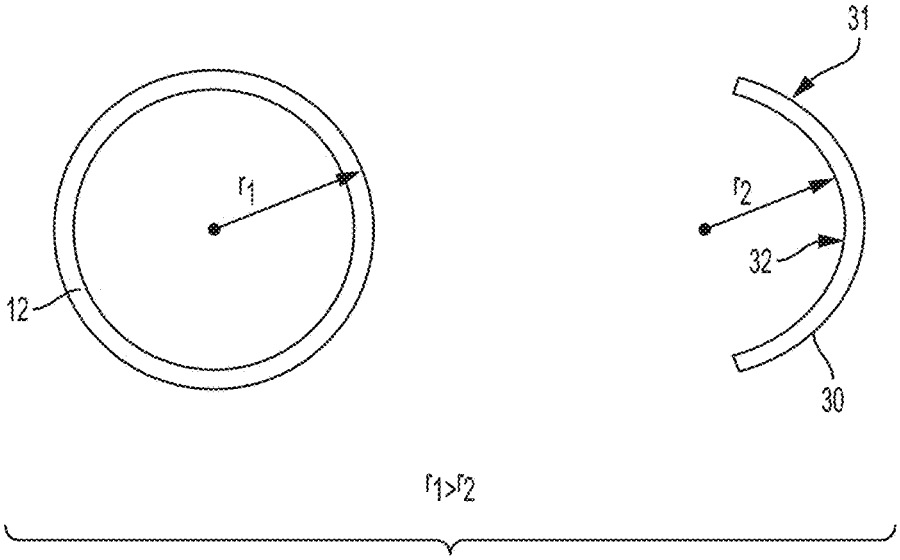
FIG. 5A is a diagrammatic representation in a horizontal plane of the column and a mounting plate of the tread assembly as in FIG. 1, illustrating respective radii.
Figure 5B:
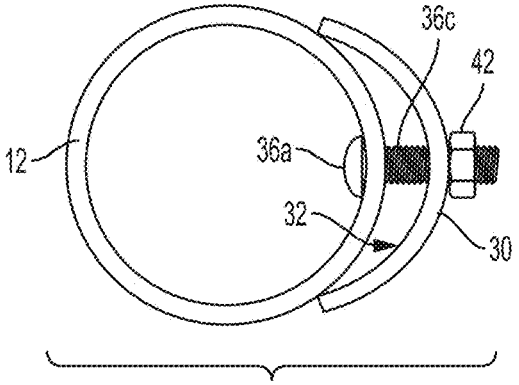
FIG. 5B illustrates the column and the mounting plate as in FIG. 5A, with the mounting plate in an unstressed state prior to attachment to the column.
Figure 5C:
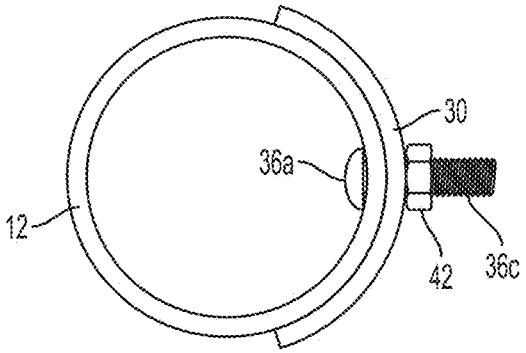
FIG. 5C illustrates the column and the mounting plate as in FIG. 5A, with the mounting plate in a stressed state once attached to the column to inhibit loosening of the attachment hardware.

Referring to FIGS. 1-3 and 5A-5C, mounting plate 30 has an outer surface 31 that faces away from column 12 and from which tread portion 15 extends and an inner surface 32, opposite outer surface 31, which defines a portion of a cylindrical surface with its curvature about a vertical axis, as oriented in FIG. 1. Before attachment to column 12 and in an unstressed state (as shown in FIG. 5B), inner surface 32 of mounting plate 30 has a radius r2 that is less than the radius r1 of the outer surface of column 12. In some embodiments, unstressed radius r2 is about 1/16" to 3/16" less than r1. In this way, when mounting plate 30 is tightened down against column 12, plate 30 elastically deforms to conform to the shape of the column's outer surface (as shown in FIG. 5C), thereby increasing the radius of curvature of inner surface 32 so that inner surface 32 substantially abuts column 12. In a preferred embodiment, mounting plate 30 may be formed of A36 hot rolled steel. Because the mounting plate's deformation is elastic, mounting plate 30 remains in tension, thereby maintaining a force that biases against the tension of the carriage bolt. This tension on the carriage bolts causes a normal force between the threads of the carriage bolts and the threads of the respective nuts 42, thereby providing a friction force between the respective components that inhibits the nut from unscrewing from the carriage bolt.

It can thus be seen that the present invention provides a novel tread mounting system for a spiral staircase. While one or more preferred embodiments of the invention have been described above, it should be understood that any and all realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed is:

1. A spiral staircase comprising:

a mounting column extending along a longitudinal axis;

a plurality of tread assemblies each having a tread portion attached to a mounting plate, each of said tread assemblies being axially and angularly offset from an adjacent one of said tread assemblies along said mounting column;

each mounting plate having a first face that engages a corresponding portion of an outer surface of said mounting column and a second face from which said tread portion extends; and each of said tread assemblies further having attachment hardware that secures said mounting plate of each said tread assembly to said mounting column, wherein, prior to attachment to the mounting column and in an unstressed state, the first face of the mounting plate has a first radius of curvature and the corresponding portion of the outer surface of the mounting column has a second radius of curvature, the first radius of curvature being less than the second radius of curvature so that when the mounting plate is secured to the mounting column with the attachment hardware and the first face of the mounting plate substantially engages the mounting column, the mounting plate is in an elastically deformed state applying tension to the attachment hardware to inhibit loosening thereof.

2. The spiral staircase as set forth in claim 1, wherein said attachment hardware comprises at least one elongate fastener.

3. The spiral staircase as set forth in claim 2, wherein said at least one elongate fastener comprises at least one threaded fastener.

4. The spiral staircase as set forth in claim 3, wherein said at least one threaded fastener comprises a plurality of bolts with corresponding nuts.

5. The spiral staircase as set forth in claim 4, wherein each of said bolts comprises a carriage bolt having a square neck portion adjacent to an enlarged head.

6. The spiral staircase as set forth in claim 1, wherein said tread portion of each said tread assembly is generally fan-shaped.

7. The spiral staircase as set forth in claim 6, wherein each mounting plate attaches to each respective tread portion via weldment.

8. The spiral staircase as set forth in claim 1, wherein said attachment hardware comprises a plurality of carriage bolts extending through respective holes defined in said mounting plate such that respective heads of said carriage bolts are spaced apart from the first face of said mounting plate.

9. The spiral staircase as set forth in claim 8, wherein said mounting column defines respective keyholes configured to receive the carriage bolts, wherein the keyholes each have an enlarged portion sized to receive the head of the carriage bolt and a reduced width slot extending from the enlarged portion for slidably receiving a square neck of the carriage bolt.

10. A tread mounting system for a spiral staircase comprising:

a mounting structure having an arcuate outer surface;

a tread assembly having a tread portion attached to an arcuate mounting plate defining at least one hole therethrough; and said tread assembly further having attachment hardware comprising at least one elongate fastener extending through said hole for connecting said tread assembly to said mounting structure;

wherein, prior to attachment to the mounting structure and in an unstressed state, a first face of the mounting plate has a first radius of curvature and the outer surface of the mounting structure has a second radius of curvature, the first radius of curvature being less than the second radius of curvature so that when the mounting plate is secured to the mounting structure with the attachment hardware and the elongate fastener is tightened, the mounting plate is in an elastically deformed state applying tension to the elongate fastener to inhibit loosening thereof.

11. The tread mounting system as set forth in claim 10, wherein said at least one elongate fastener comprises a plurality of bolts with corresponding nuts and said at least one hole comprises a plurality of holes, each of said bolts extending through a corresponding one of said plurality of holes defined in said mounting plate.

12. The tread mounting system as set forth in claim 11, wherein each of said bolts comprises a carriage bolt having a square neck portion adjacent to an enlarged head.

13. The tread mounting system as set forth in claim 12, wherein each of said carriage bolts extends through said mounting plate such that said enlarged head thereof is spaced apart from the first face of said mounting plate.

14. The tread mounting system as set forth in claim 13, wherein said mounting structure defines respective keyholes configured to receive the carriage bolts, wherein the keyholes each have an enlarged portion sized to receive the head of the carriage bolt and a reduced width slot extending from the enlarged portion for slidably receiving a square neck of the carriage bolt.

15. The tread mounting system as set forth in claim 10, wherein said tread portion of each said tread assembly is generally fan-shaped.

* * * * *